US007549955B2

(12) United States Patent
Rathbun et al.

(10) Patent No.: US 7,549,955 B2
(45) Date of Patent: Jun. 23, 2009

(54) METHOD AND DEVICE FOR CREASING PAPER

(75) Inventors: Darryl T. Rathbun, Stratford, CT (US); Thomas J. Foth, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 569 days.

(21) Appl. No.: 11/001,477

(22) Filed: Dec. 1, 2004

(65) Prior Publication Data

US 2006/0116263 A1 Jun. 1, 2006

(51) Int. Cl.
*B31B 41/00* (2006.01)
*B31B 1/00* (2006.01)

(52) U.S. Cl. ..... 493/356; 493/59; 493/81

(58) Field of Classification Search ..... 493/59, 493/81, 8, 10, 23, 356, 357, 360, 396, 397, 493/430, 434

See application file for complete search history.

(56) References Cited

U.S. PATENT DOCUMENTS

| | | | | | |
|---|---|---|---|---|---|
| 3,413,706 | A * | 12/1968 | Marchant et al. | 29/407.1 |
| 4,095,780 | A * | 6/1978 | Gaspar et al. | 493/430 |
| 4,227,683 | A * | 10/1980 | Spangler et al. | 493/10 |
| 4,668,212 | A * | 5/1987 | Kotani | 493/216 |
| 4,701,233 | A | 10/1987 | Beck et al. | |
| 4,721,295 | A * | 1/1988 | Hathaway | 270/39.02 |
| 4,810,239 | A * | 3/1989 | Moss | 493/10 |
| 4,875,965 | A | 10/1989 | Marzullo | |
| 4,944,131 | A | 7/1990 | Gough | |
| 5,393,295 | A * | 2/1995 | Knecht | 493/403 |
| 5,937,723 | A * | 8/1999 | Kirikoshi et al. | 83/614 |
| 6,041,988 | A * | 3/2000 | Shapiro | 225/1 |
| 6,071,221 | A * | 6/2000 | Lozano | 493/340 |
| 6,138,546 | A * | 10/2000 | Hursey | 83/875 |
| 6,290,635 | B1 * | 9/2001 | Demmel et al. | 493/399 |
| 6,672,815 | B2 * | 1/2004 | Parker et al. | 412/33 |
| 6,702,284 | B2 | 3/2004 | Sette et al. | |
| 6,865,864 | B2 * | 3/2005 | Katz | 53/460 |
| 6,916,280 | B2 * | 7/2005 | Tonnigs et al. | 493/424 |
| 6,945,645 | B2 * | 9/2005 | Baron | 347/104 |
| 2005/0043160 | A1 * | 2/2005 | Neubauer et al. | 493/356 |

* cited by examiner

*Primary Examiner*—Rinaldi I. Rada
*Assistant Examiner*—John Paradiso
(74) *Attorney, Agent, or Firm*—Ronald Reichman; Angelo N. Chaclas

(57) ABSTRACT

In a printer system where a print head is used to print on a flat material moving on a surface along a moving direction, a first creasing surface and a second creasing surface disposed on different sides of the flat material are used to make a crease on the flat material. The first creasing surface is mounted on a housing and the second creasing surface is disposed along the length of a track substantially perpendicular to the moving direction. The first and second creasing surfaces are substantially complementary to each other such that when these creasing surfaces are moved closer to each other, they cause the flat material to bend. A movement mechanism is then used to move the housing along the track so that the bending of the flat material forms a crease from one side of the flat material to the opposing side.

11 Claims, 12 Drawing Sheets

METHOD AND DEVICE FOR CREASING PAPER

TECHNICAL FIELD

The present invention relates generally to a device for creasing paper for folding and, more particularly, to a creasing device for use in a printer.

BACKGROUND OF THE INVENTION

Folding documents prior to inserting them into an envelope for mailing is an important task in mass mailing. In large volumes, a folding machine can be used. Folding machines are well known. For example, U.S. Pat. No. 4,701,233 (Beck et al.) discloses a method of folding a sheet by bulging a portion of the sheet and then folding the bulged portion through a roller nip. U.S. Pat. No. 4,875,965 (Marzullo) discloses a folding apparatus wherein a buckle chute is used for stopping a sheet, causing the sheet to enter a roller nip for folding. U.S. Pat. No. 4,944,131 (Gough) also discloses a folding apparatus having a buckle chute. Folding machines are generally designed for folding enclosure material to be inserted into envelopes in an envelope-inserting device.

Folding machines are also designed for making self-mailers. A self-mailer is conventionally defined as a mailpiece without an envelope. The mailer usually contains one or more sheets of printed material, folded once or twice by a folding machine into a smaller piece for mailing. The folded material has a folded end and an open end. The open end is sealed with one or more tabs before the self-mailer is sent to the addressee. In addition, it may be required for an address label and a postage stamp or indicia to be applied to or printed on the folded material. Thus, the components of a commercially available equipment for self mailers can generally be grouped into a printer, a folding machine, a labeler and a tabbing device. The folding machines for making self-mailers are disposed in U.S. Pat. No. 6,702,284 (Sette et al.), for example.

The folding machines as disclosed in the above-mentioned references are separate units in a mailing system in that they are used to fold the printed materials after the printing process is completed. One of the major advantages of these folding machines is that the printed materials or inserted documents do not require creasing prior to folding. However, the device for simultaneous creasing and folding, in general, is mechanically complex.

For a mail preparer with a small volume of mail, he or she usually hand folds the documents to be inserted. Typically a C-fold or Z-fold is made on the documents for a #10 envelope. Unlike folding the documents in half where one can line up one edge with the opposite edge, folding in thirds must be approximated. If the approximation is off, the address may not be clearly visible in a windowed-envelope, or the insert may not fit in the envelope. It is thus desirable and advantageous to provide a method and device for creasing the inserted documents in a cost-effective way to facilitate subsequent folding by hand.

SUMMARY OF THE INVENTION

The creasing device of the present invention can avoid and overcome the disadvantages of the prior art folding methods.

In one embodiment of the present invention, one or more rollers with a pointed periphery or a notched periphery are used to crease a sheet of paper together with a mating surface component disposed below the paper when the paper passes through a printer. The rollers are mounted on a printer assembly such that when the printer assembly is moved across the width of the paper in a direction perpendicular to the moving direction of the paper, they make a crease from one edge of the paper to another. The mating surface component is normally retracted away from the pointed periphery or notched periphery to allow the paper to pass under the printer assembly without being creased even when the printer assembly is moved across the width of the paper for printing on the paper. The paper that passes through the printer may be creased one or more times. However, when the paper exits the printer, it is pre-creased at one or more locations to facilitate folding, but it is not folded. The folding can be carried out manually or by a folding apparatus.

In particular, the printer assembly is movable along one or more linear tracks disposed substantially perpendicular to the moving direction of the incoming sheet of paper. The printer assembly comprises a print head fixedly disposed thereon and above a printer surface for printing a sheet of paper moved into the gap between the printer surface and the print head while the printing assembly is moved along the linear tracks. Each of the rollers has a width, and the width is divided into at least two width sections. One of the two width sections has a periphery with a pointed edge, and the other width section has a periphery with a notch or a V-shaped groove. A linear mating track assembly comprising two mating tracks is disposed substantially parallel to the linear tracks. A first mating track with a linear V-shaped groove is disposed directly under the pointed periphery of the rollers. A second mating track with a linear pointed edge is disposed directly under the notched periphery of the rollers. Normally these mating tracks are located below the printer surface so as not to interfere with the movement of the paper. When a concave crease is to be made on the paper, the first mating track is moved upward by a solenoid or a similar device so that only a small gap exists between the V-shaped groove of the first mating track and the pointed periphery of the rollers. As such, the action of the printer assembly moving across the width of the paper causes the rollers to progressively make a downward crease from one edge of the paper to the other edge of the paper. Similarly, when a convex crease is to be made, the second mating track is moved upward to produce a gap between the pointed edge and the notched periphery of the rollers.

In another embodiment of the present invention, one or more rollers with flat radial surface are used instead of the rollers with pointed periphery. The flat radial surface, along with another flat surface, forces the paper to bend upward or downward.

Alternatively, the rollers are lowered toward the mating track to make the creases. It is also possible that the rollers are replaced by stationary edges.

The present invention will become apparent upon reading the description taken in conjunction with FIGS. 1-8*b*.

DETAILED DESCRIPTION OF THE INVENTION

Figure 1:
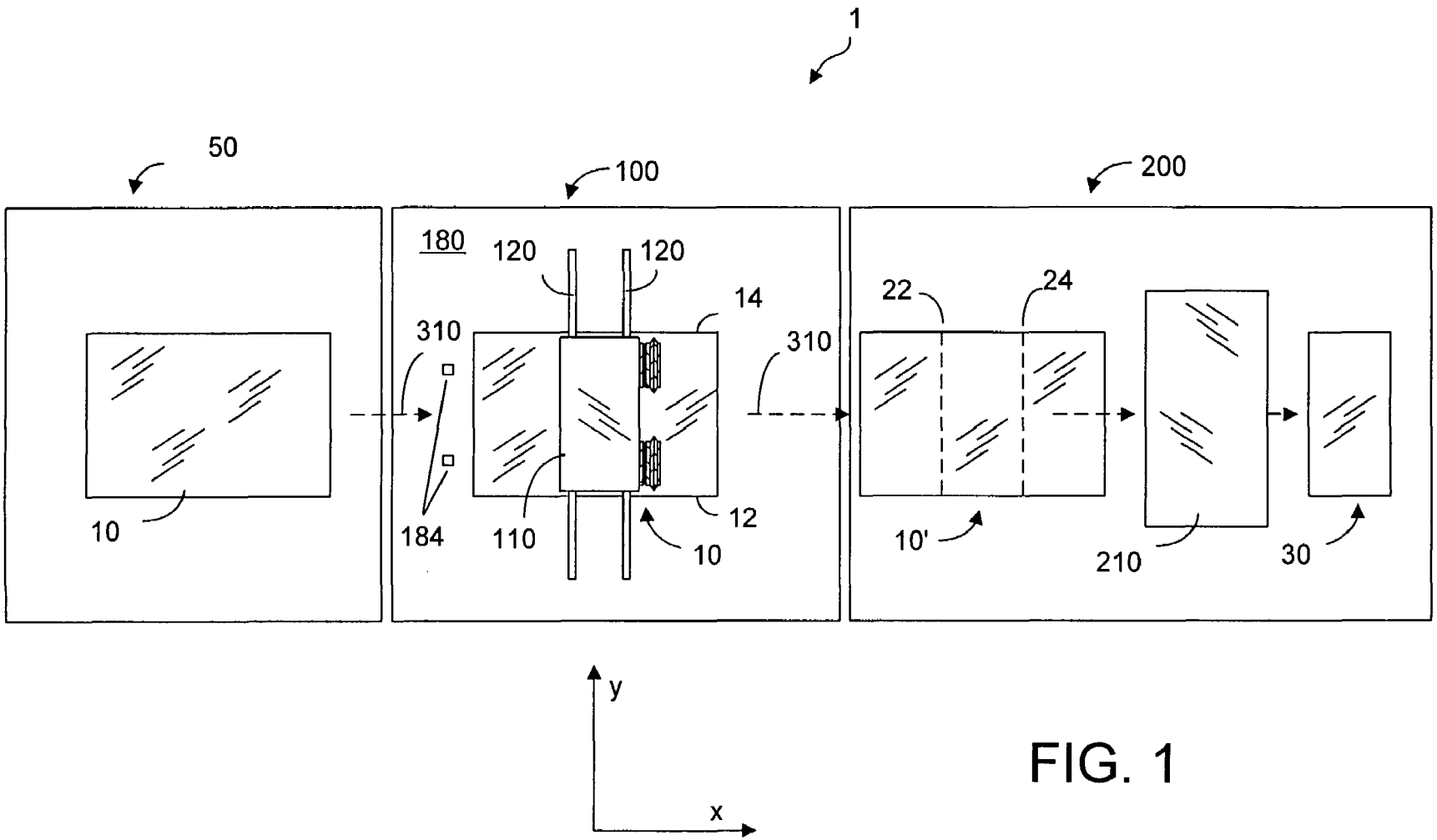
FIG. 1 is a schematic representation showing a mailing machine having a creasing device, according to the present invention.

A typical mailing machine 1, such as a self-mailer, may comprise a paper supply 50 to supply one sheet of paper 10 at a time to a printer 100 for printing. As shown in FIG. 1, the paper is moved along a moving direction 310, onto a printer surface 180 of the printer 100. The moving direction 310 is parallel to the x direction. The printer 100 has a printer assembly 110, movably disposed in relation to a pair of linear tracks 120 for moving across the width of the paper 10 along the y direction. A creasing device (see FIGS. 2 to 3*c*) mounted on the printer assembly 110 is utilized for making creases on the paper 10 from one side 12 to the other side 14. One or more sensors 184 are used to detect the lead edge of the paper 10 to determine when to make a crease based on the number of steps of the stepper motor controlling the paper movement. The paper exits the printer 100 after being creased with creases 22 and 24. The creased paper 10' can easily be folded the rest of the way by hand. Alternatively, the creased paper 10' can also be folded by a folding device 210 in a folding station 200 into a folded piece 30.

Figure 2:
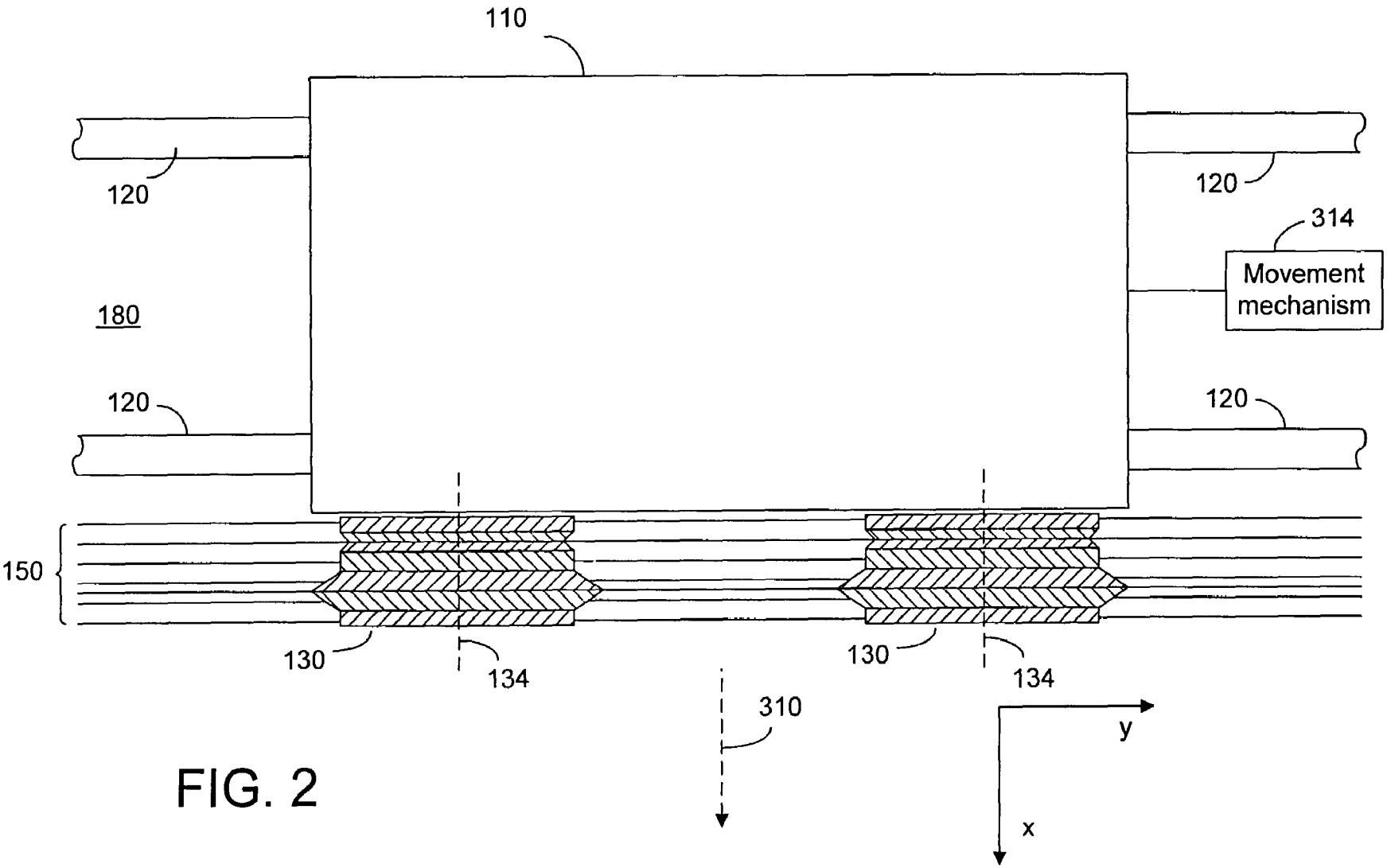
FIG. 2 is a schematic representation of a top view showing a printer having a printer assembly and the creasing device, according to the present invention.

The creasing device, according to the present invention, comprises one or more creasing rollers 130 movably mounted on the printer assembly 110 for rotation on a rotation axis 134 as shown in FIG. 2. The creasing device further comprises a mating track assembly 150 disposed in relation to the printer surface 180, parallel to the linear tracks 120. A movement mechanism 314 is used to move the printer assembly 110, along with the creasing rollers 130, along the y direction for printing or creasing the paper 10 passing under the printer assembly 110, as shown in FIG. 7B.

Figure 3A:
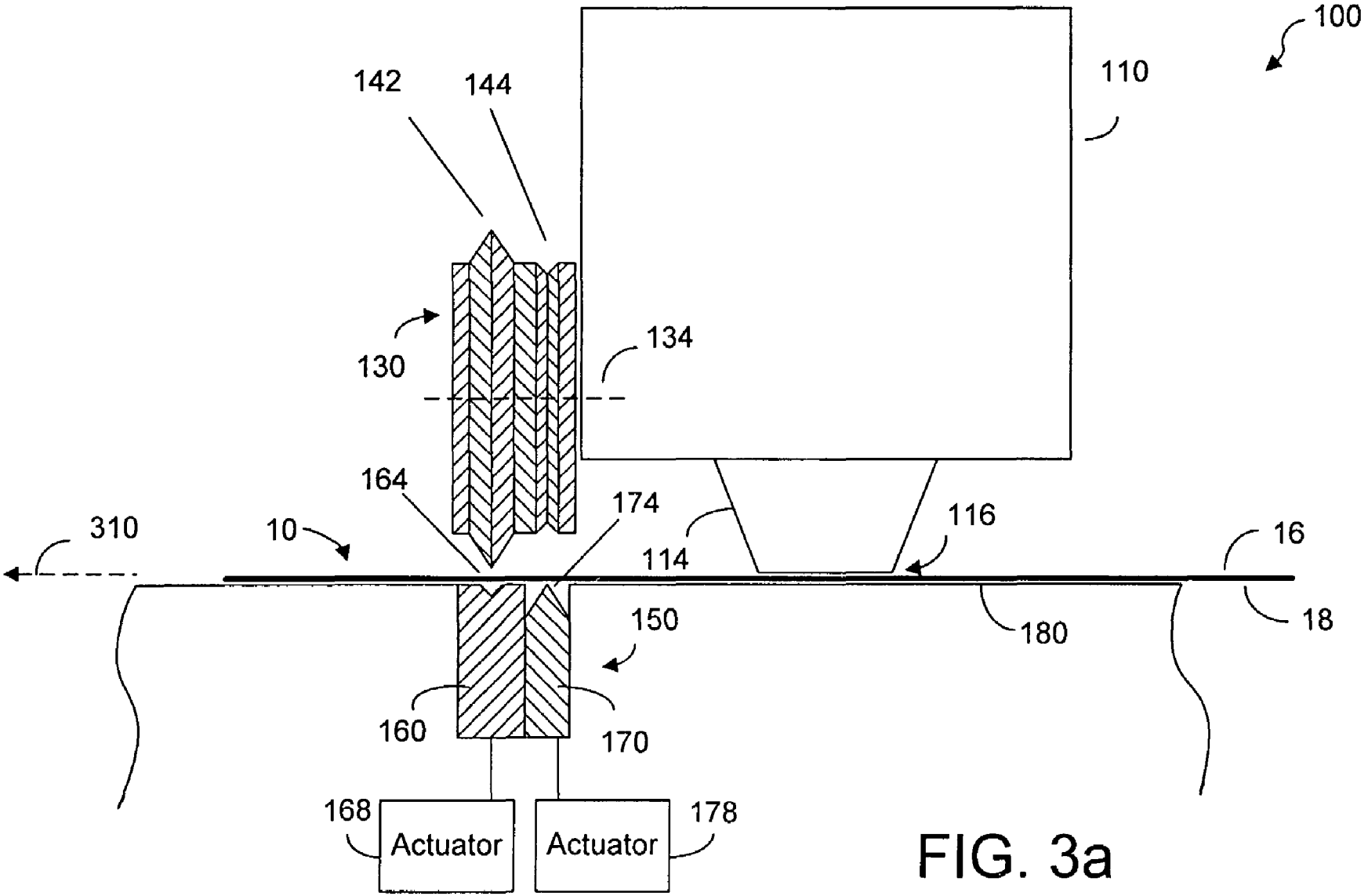
FIG. 3*a* is a schematic representation of a side view of FIG. 2 showing the creasing device of the present invention, wherein the mating tracks are in a recess position.

As shown in FIG. 3*a*, the printer assembly 110 has a print-head 114 fixedly disposed thereon, leaving a gap 116 between the print-head 114 and the printer surface 180. Each of the rollers 130 has a width. A section of the width has a pointed periphery 142, and another section of the width has a notched periphery 144. The linear mating track assembly 150 comprises a first mating track 160 with a V-shaped groove 164 and a second mating track 170 with a pointed edge 174. Normally, the mating tracks 160 and 170 are located substantially below the printer surface 180 to allow the paper 10 to move freely along the moving direction 310 through the gap 116. The first and second mating track 160, 170 are operatively connected to actuators 168, 178, such as solenoids or other similar devices, so that one of the mating tracks can be moved upward when so desired. As shown in FIG. 3*a*, the paper 10 has a printed side 16 and a backside 18. A concave crease or a convex crease can be made on the printed side 16 as shown in FIGS. 3*b* and 3*c*.

Figure 3B:
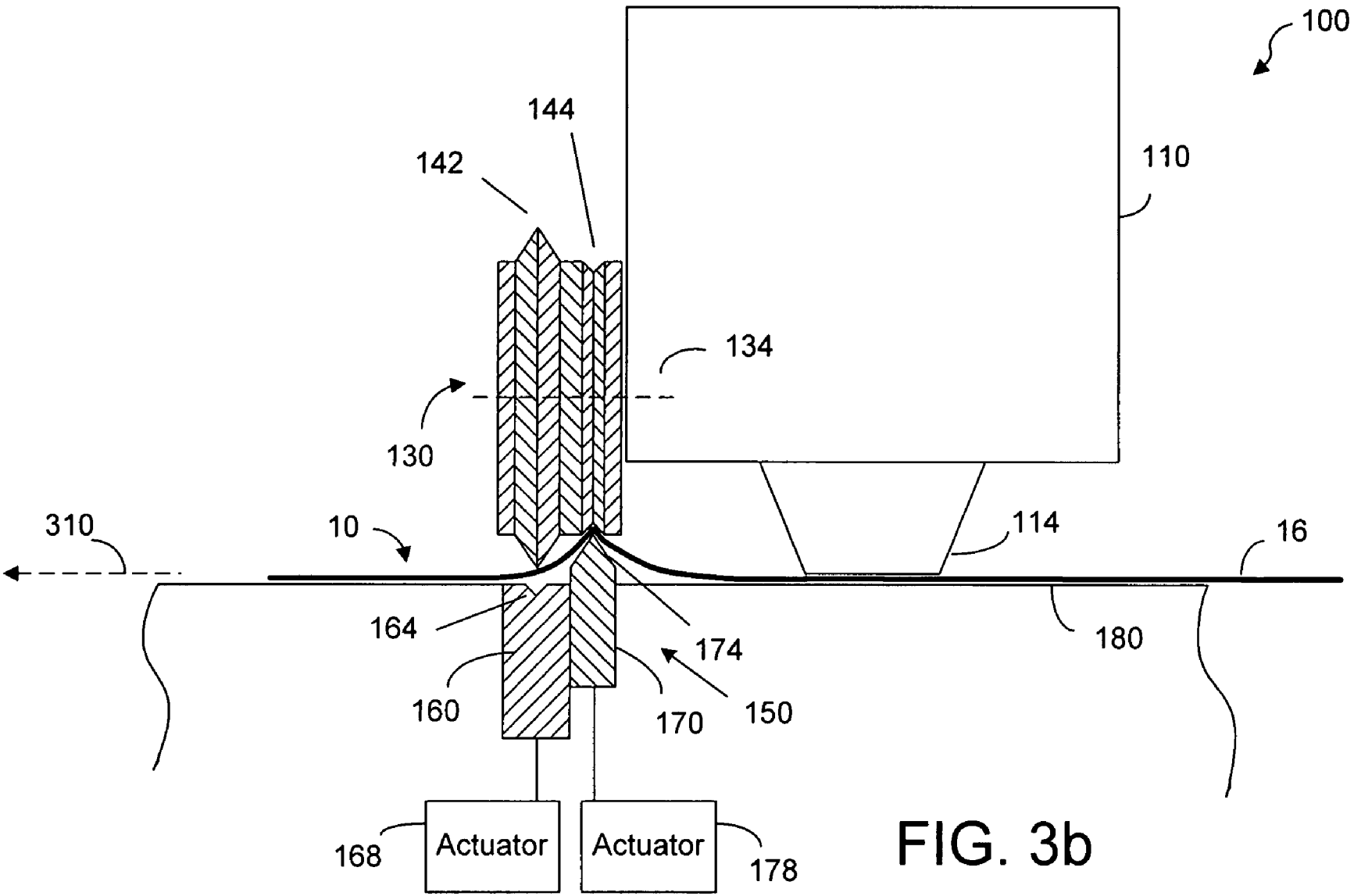
FIG. 3*b* is a schematic representation of a side view of FIG. 2 showing the creasing device of the present invention, wherein the linear track with a pointed edge is pushed upward for making a convex crease.

FIG. 3*b* shows how a convex crease is made to the printed side 16. When a convex crease is to be made, the second mating track 170 is moved upward by the actuator 178, pushing the paper 10 to contact the notched periphery 144 of the creasing rollers 130. The printer assembly 110 is moved by the movement mechanism 314 along the y direction (see FIG. 2) to make a crease substantially across the entire width of the sheet of paper 10.

Figure 3C:
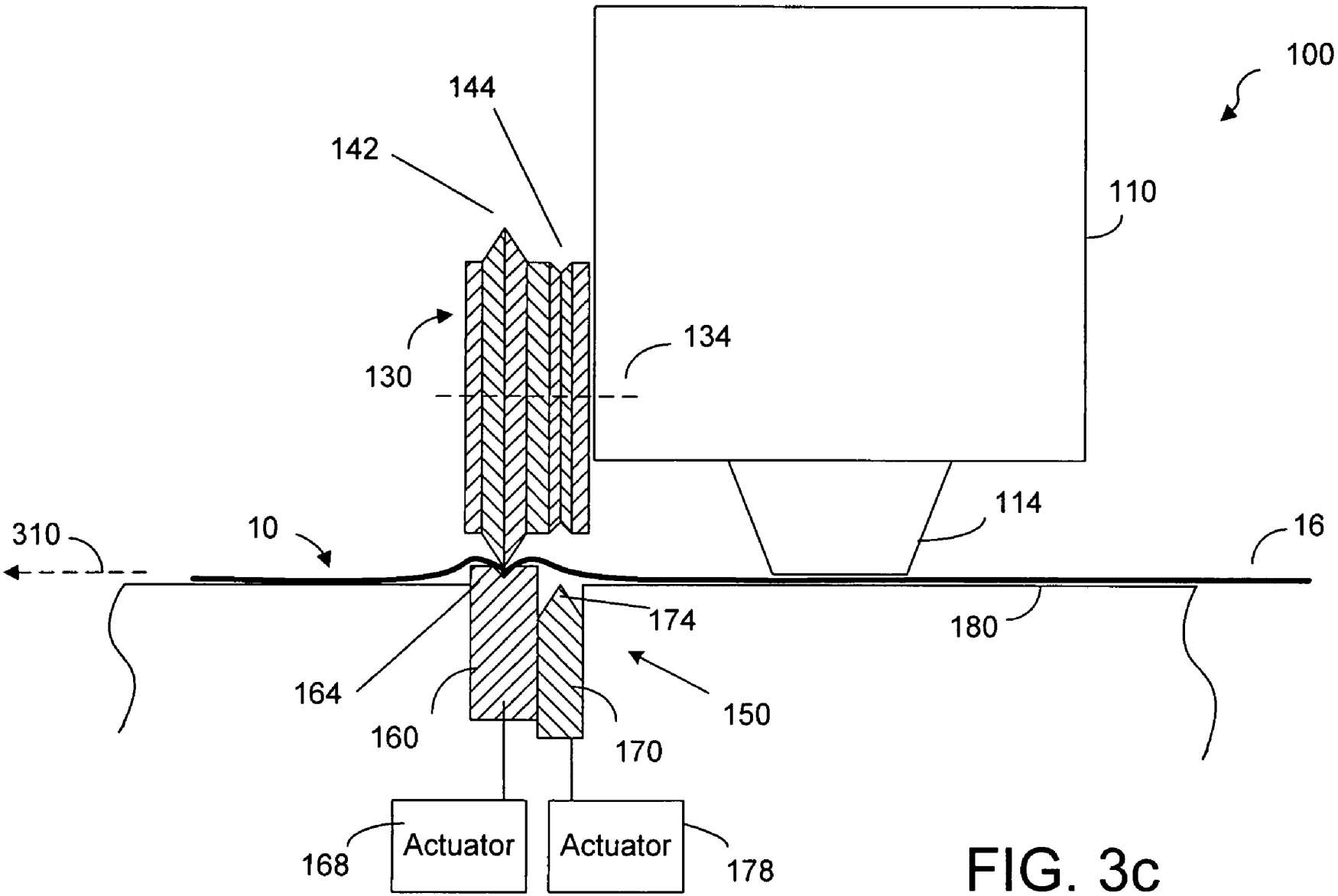
FIG. 3*c* is a schematic representation of a side view of FIG. 2 showing the creasing device of the present invention, wherein the linear track with a V-shaped groove is pushed upward for making a concave crease.

FIG. 3*c* shows how a concave crease is made to the printed side 16. When a concave crease is to be made, the first mating track 160 is moved upward by the actuator 168, pushing the paper 10 to contact the pointed periphery 142 of the creasing rollers 130. The printer assembly 110 is moved by the movement mechanism 314 along the y direction to make a crease substantially across the entire width of the sheet of paper 10.

Figure 4:
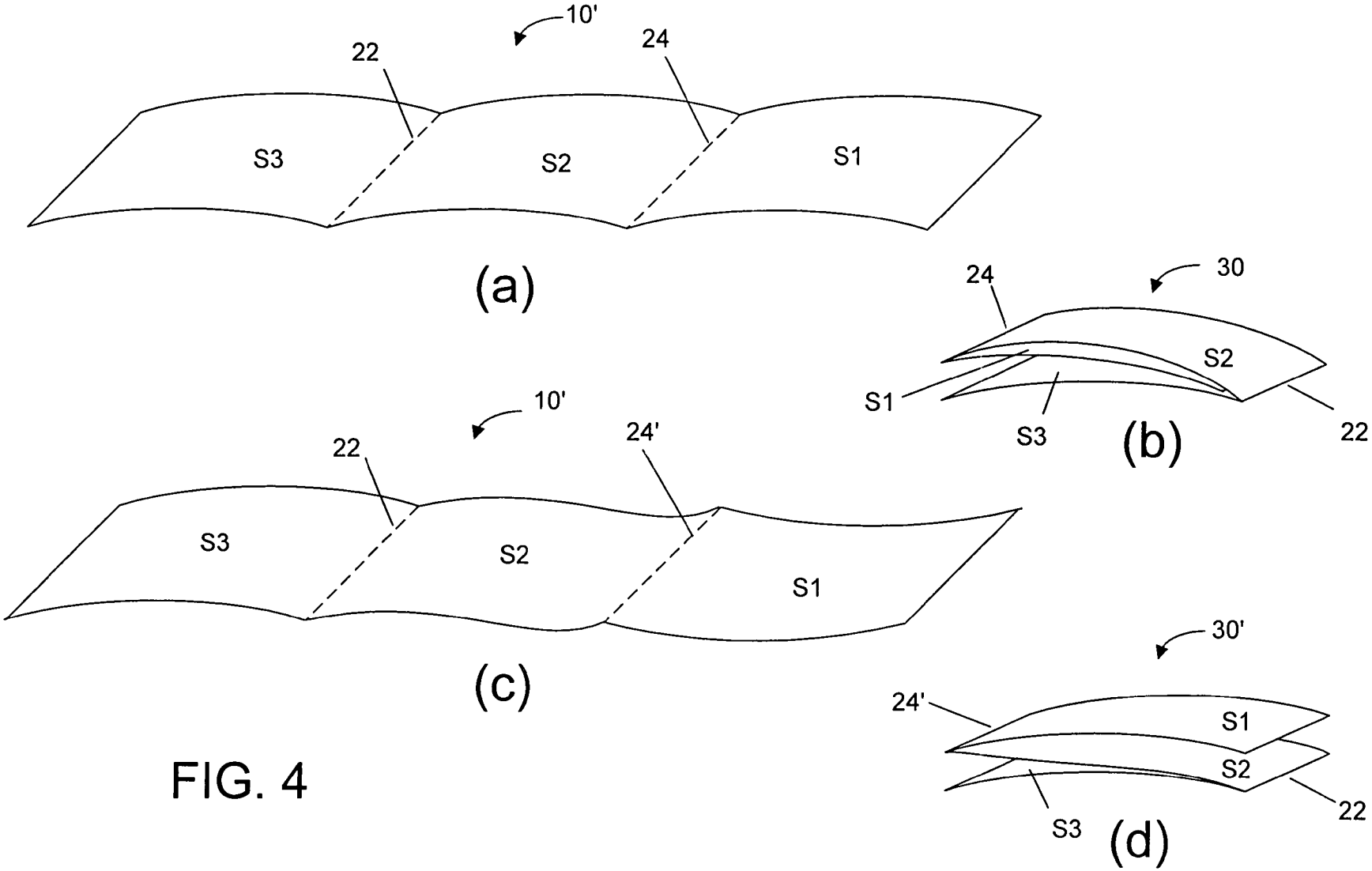
FIG. 4*a* is schematic representation showing a pre-creased sheet of paper for making a C-fold.
FIG. 4*b* is a schematic representation showing a C-folded sheet.
FIG. 4*c* is schematic representation showing a pre-creased sheet of paper for making a Z-fold.
FIG. 4*d* is a schematic representation showing a Z-folded sheet.

As the paper exits the printer 100, it may have one or more creases made across its width. The creases can be concave or convex, depending on what type of fold is made. A traditional C-fold folds a paper in thirds so that the text printed on the printed side 16 is on the inside of the fold. FIGS. 4*a* and 4*b* show how a C-fold is made. As shown in FIG. 4*a*, the creased paper 10' has two concave creases 22 and 24, separating the paper length into three sections S1, S2 and S3. After the creased paper 10' is folded along the creases 22 and 24, it becomes a folded piece 30 having a C-fold, as shown in FIG. 4*b*.

For a Z-fold, the fold near the trail edge of the page is the same as that in a C-fold. Thus, the crease 22 on the creased paper 10' is concave to the printed side. However, near the lead edge of the creased paper 10' must be convex to the printed side so the address will be on the outside of the Z-fold. As such, the address can be visible through a window envelope after the folded piece is inserted in the envelope (not shown). As shown in FIG. 4*c*, the creased paper 10' has a concave crease 22 and a convex crease 24'. After being folded, the creased paper 10' becomes a folded piece 30' with a Z-fold, as shown in FIG. 4*d*.

Figure 5B:
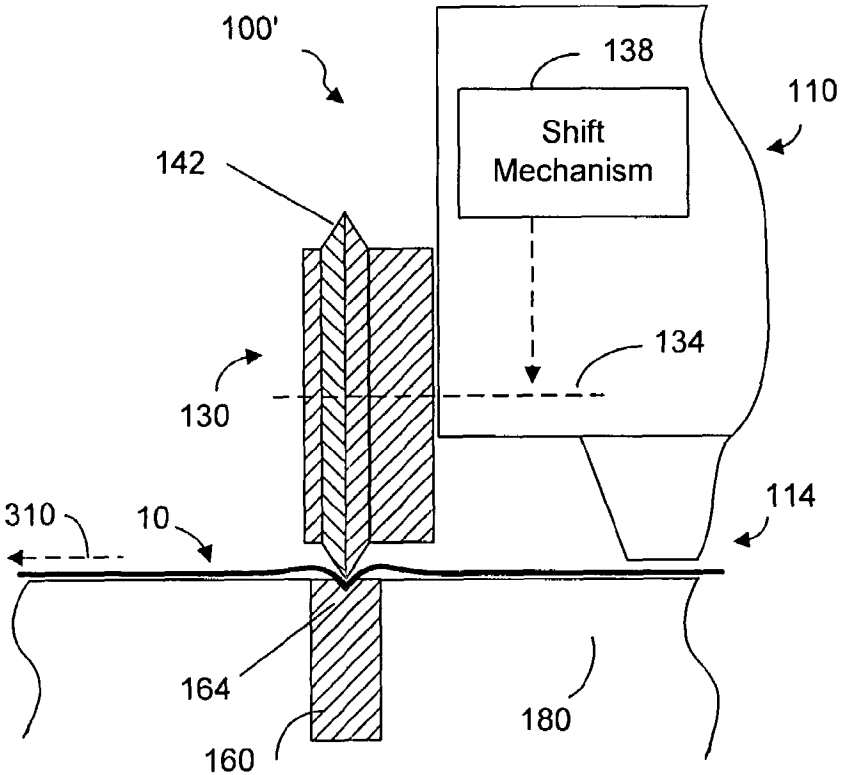
FIG. 5*b* is a schematic representation of a side view of FIG. 2 showing the different embodiment of the creasing device when creasing is being carried out.
Figure 5A:
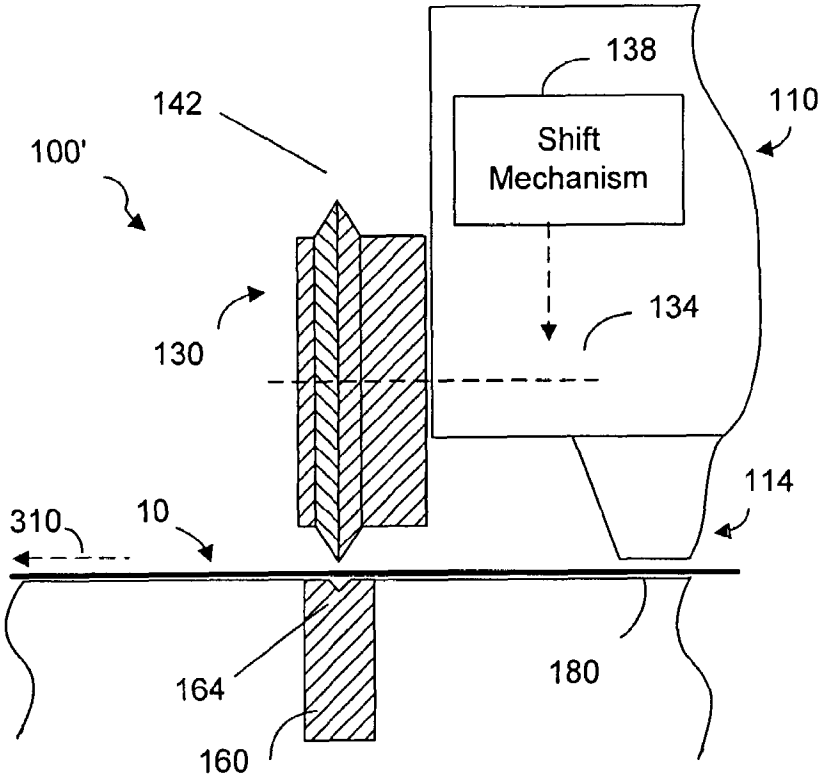
FIG. 5*a* is a schematic representation of a side view of FIG. 2 showing a different embodiment of the creasing device when creasing is not carried out.

One skilled in the art would be able to appreciate that it is possible to lower the roller 130, rather than raising the mating track, to make a crease on the paper 10. As shown in FIGS. 5*a* and 5*b*, only the pointed periphery 142 of the roller 130 is used for making concave creases on the paper 10. Thus, only one mating track 160 is needed. As shown, the mating track 160 is fixedly mounted on the printer, substantially below the printer surface 180. The roller 130 is movably mounted on the printer assembly 110 so that it can be moved up and down by a shift mechanism 138 when needed. Normally the roller 130 is positioned away from the mating track 160, as shown in FIG. 5*a*. During creasing, the roller 130 is lowered so that the pointed periphery 142 is in close proximity of the V-shaped groove 164 of the track 160, causing a part of the paper 10 to bend downward, as shown in FIG. 5*b*. When the printer assembly 110 is moved from one side of the paper to another side, a concave crease is achieved.

Similarly, a separate roller containing only a notched periphery 144 could be movably mounted on the printer assembly 110 so that it can be lowered to be in close proximity of a pointed track 170 to make a convex crease.

Figure 6B:
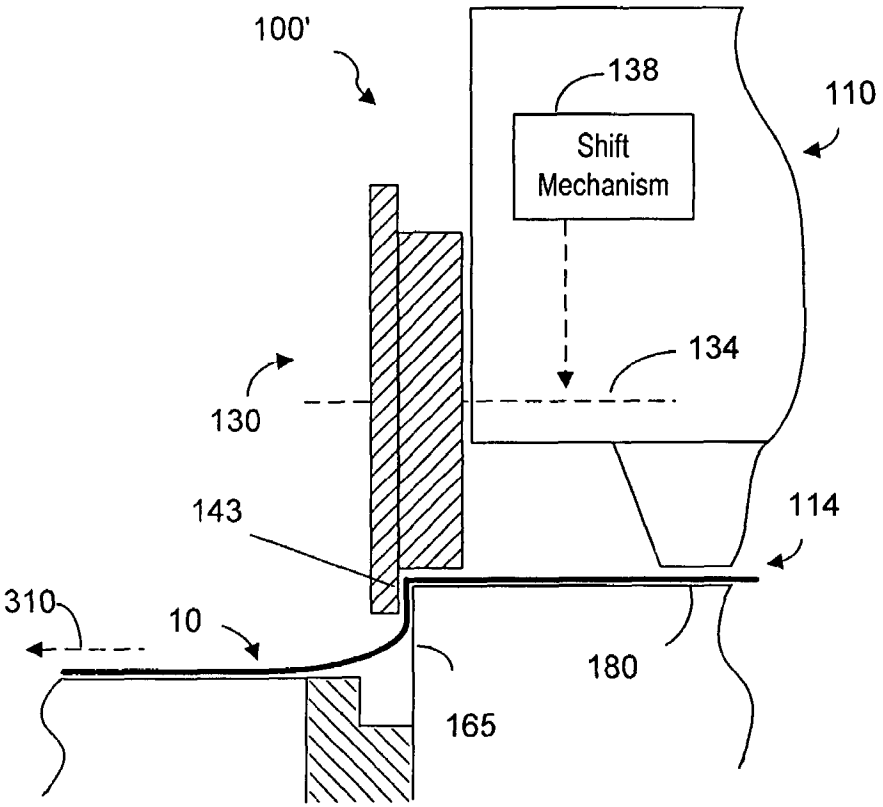
FIG. 6*b* is a schematic representation showing a side view of the embodiment shown in FIG. 6*a* when creasing is being carried out to make a convex crease.
Figure 6A:
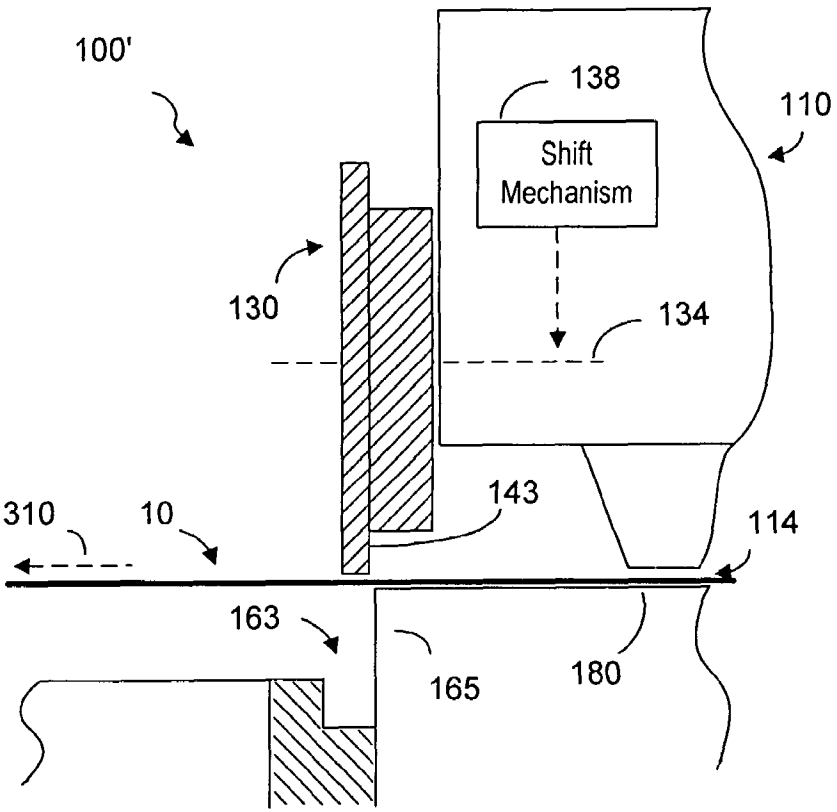
FIG. 6*a* is a schematic representation showing yet a different embodiment of the creasing device, according to the present invention when creasing is not carried out.
Figure 6C:
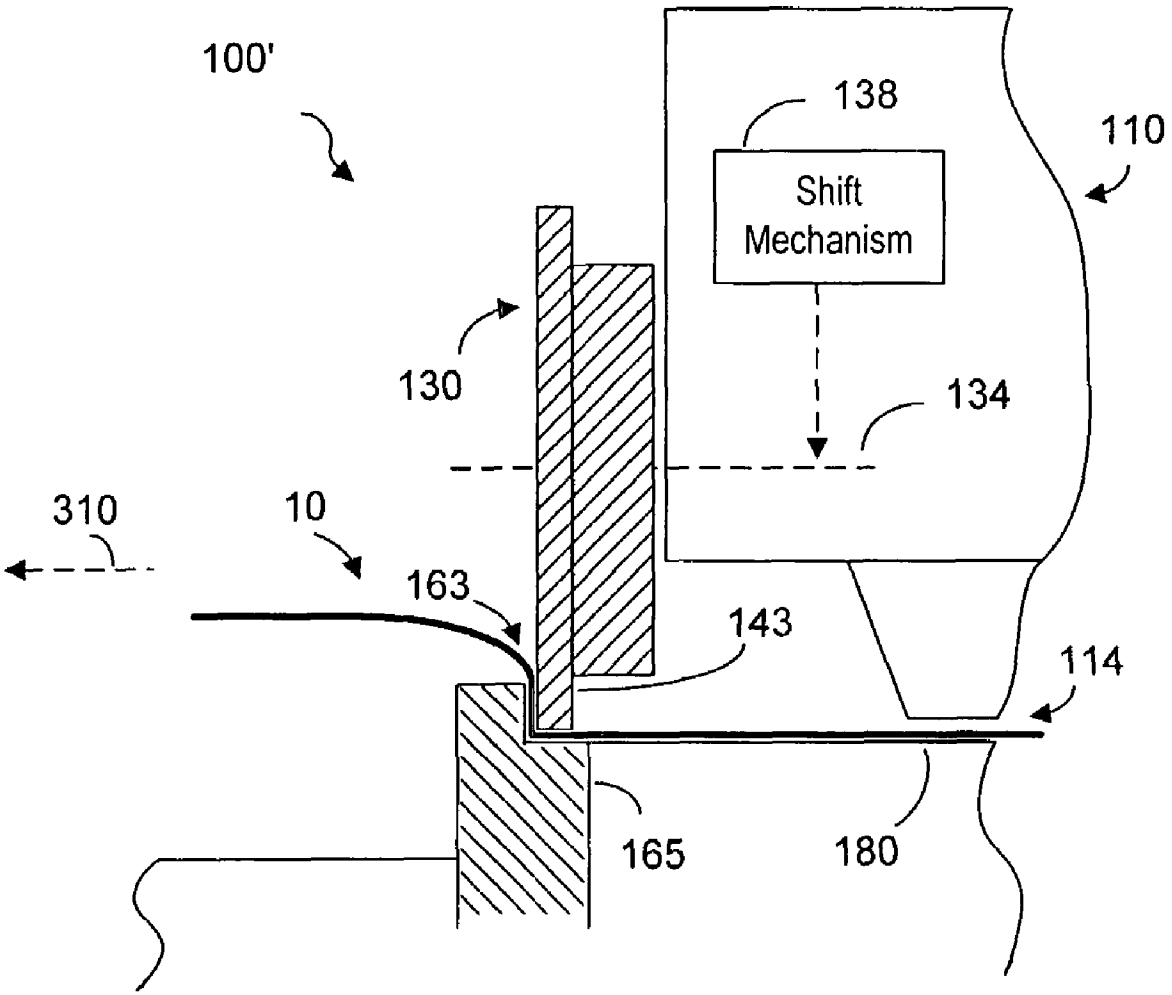
FIG. 6*c* is a schematic representation showing a side view of the embodiment shown in FIG. 6*a* when creasing is being carried out to make a concave crease.

In a different embodiment of the present invention, the width of the roller 130 has a flat radial surface segment 143, as shown in FIGS. 6*a* to 6*c*. The linear mating track assembly comprises a downward step 163 having a flat surface 165 substantially parallel to the radial surface segment 143 of the roller 130. When the roller is lowered to make a crease on the paper 10, the flat surface 165 and the radial surface segment 143 form a narrow gap between them, forcing the paper 10 to bend downward through the gap, as shown in FIG. 6*b*. As the roller is moved along the y direction (see FIG. 2), a convex crease is made on the paper 10 across the width of the paper 10. Alternatively, the linear track is moved upward so that the step 163 and the outer surface of the roller 130 force the paper 10 to bend upward, as shown in FIG. 6*c*.

Figure 7A:
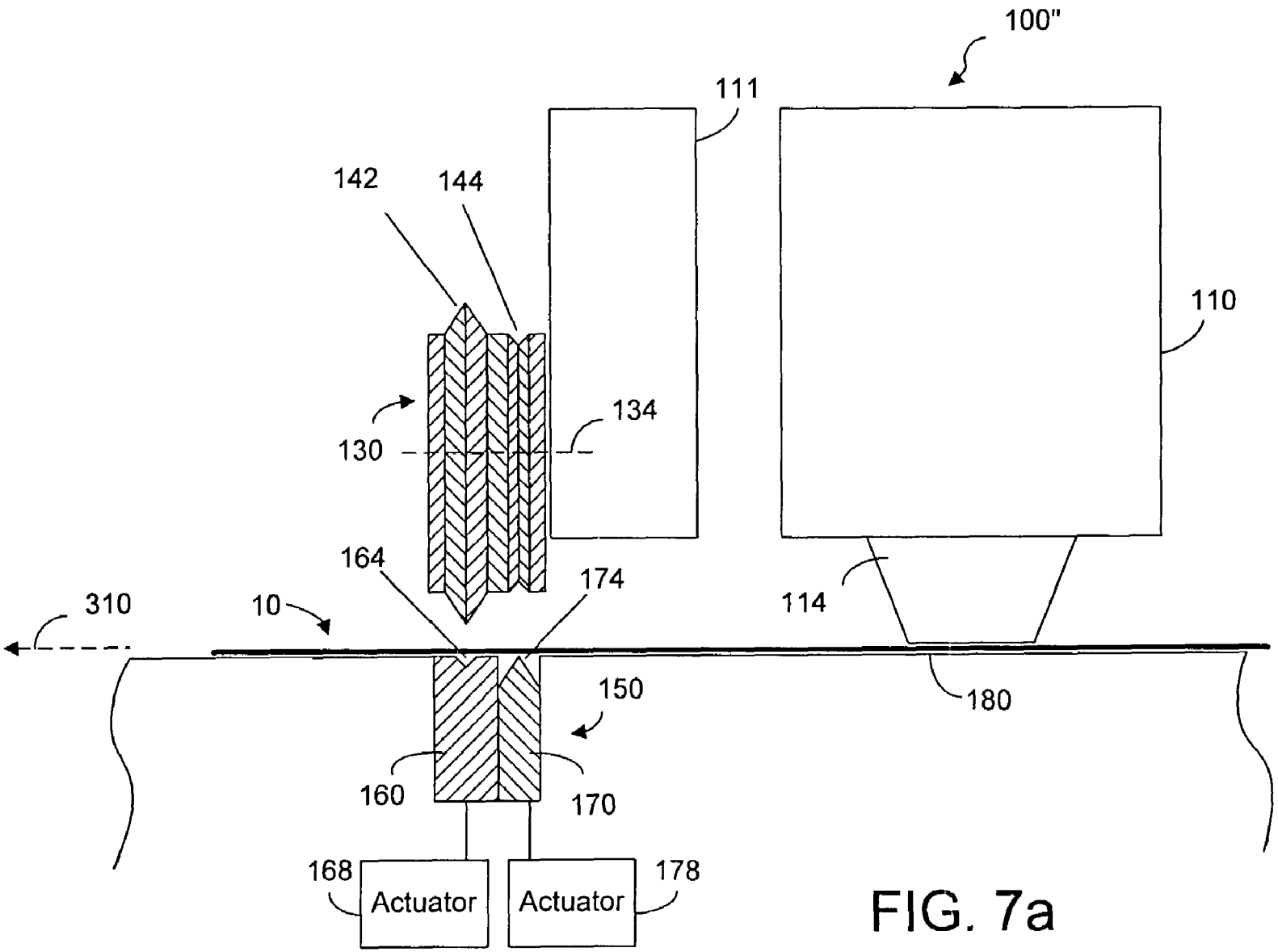
FIG. 7*a* is a schematic representation showing still another embodiment of the crease device, according to the present invention.
Figure 7B:
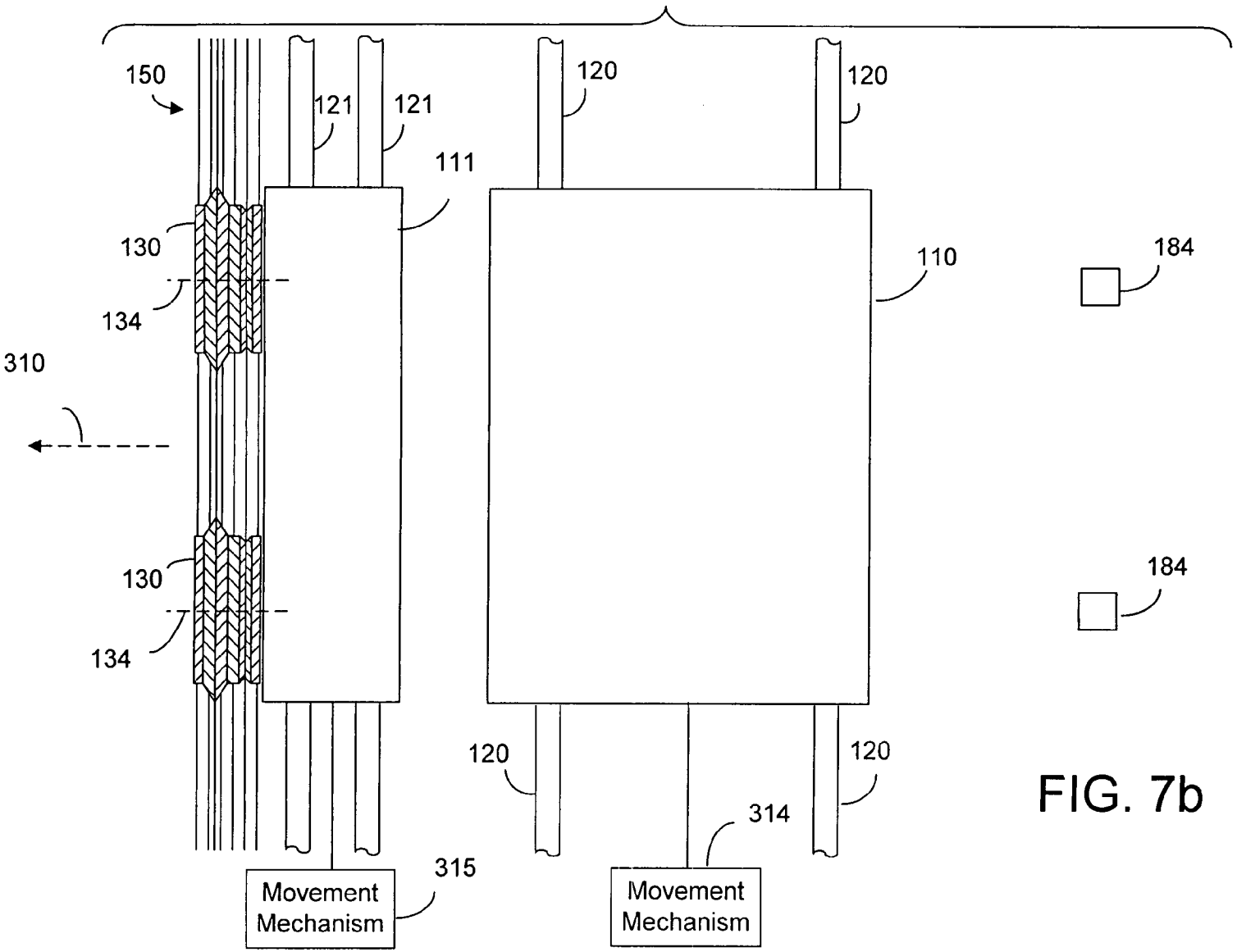
FIG. 7*b* is a schematic representation of a side view of FIG. 2 showing a different view of the embodiment shown in FIG. 7*a*.

Furthermore, the roller 130 can be mounted on a separate housing 111, as shown in FIGS. 7*a* and 7*b*. As shown in FIG. 7*b*, the housing 111 is movably mounted on a pair of linear tracks 121 and operatively connected to a separate movement mechanism 315. As such, creasing the paper 10 can be carried out independently of the movement of the print-head assembly 110.

Figure 8B:
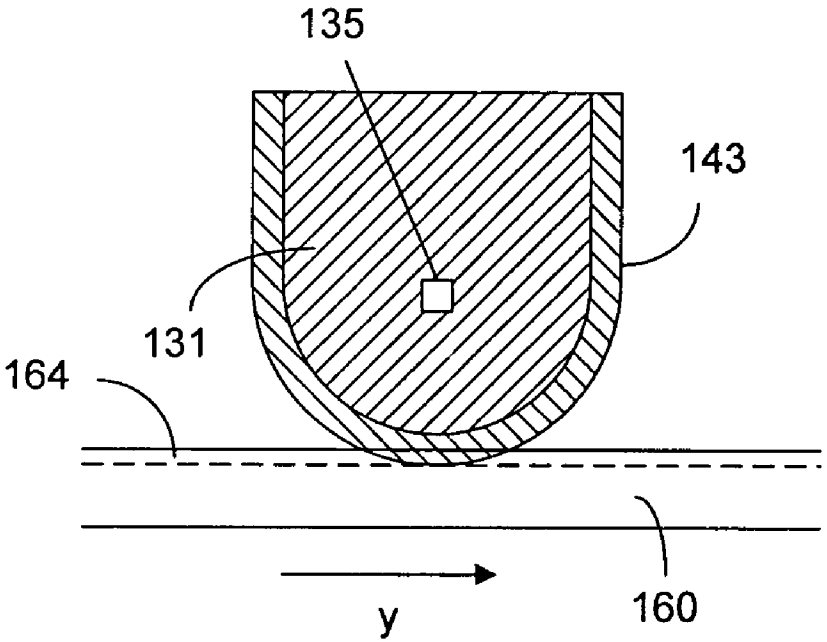
FIG. 8*b* is a schematic representation showing a non-rotatable member is used for disposing the upper creasing surface on the lower edge of the non-rotatable member.
Figure 8A:
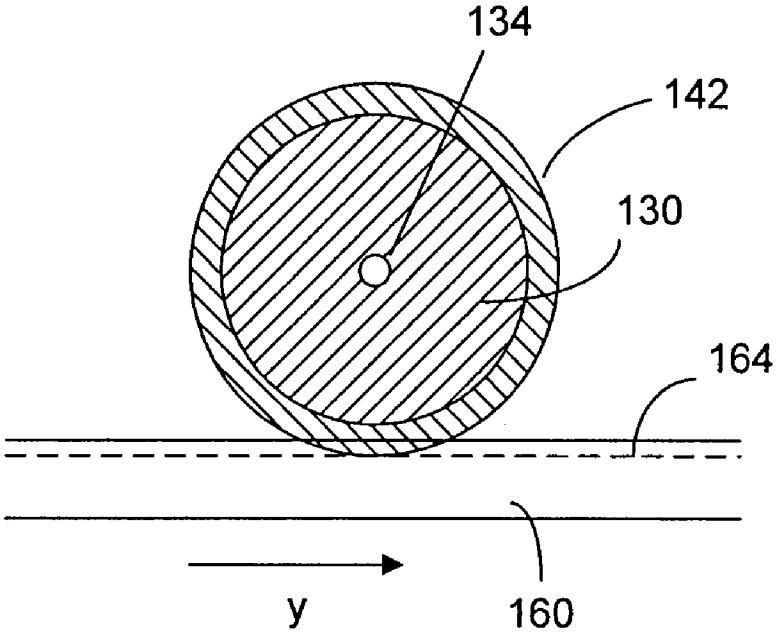
FIG. 8*a* is a schematic representation showing a roller is used for disposing an upper creasing surface on the roller periphery.

It is also possible that the roller 130 with a pointed edge 142 is replaced by a non-rotatable member 131 with a pointed edge 143, as shown in FIGS. 8*a* and 8*b*. As shown in the FIG. 8*b*, the non-rotatable member 131 is mounted to mounting member 135 which can be moved in a vertical direction so that the non-rotatable member 131 can be moved downward toward the mating track 160, for example.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A device for creasing a piece of flat material said device comprising:

(A) a printing device having a housing and a print-head positioned in relationship to a printer surface of the printing device for printing on a flat material that moves along a moving path on the printer surface;

(B) at least a first creasing surface disposed on the housing;

(C) a track disposed in relationship to the printer surface, the track having a second creasing surface communicating at least part of the length of the track;

(D) a shifting mechanism for positioning the track and first creasing surface relative to each other between a first position and a second position so that, in a first position, the first creasing surface is spaced away from the track and, in the second position, the first creasing surface is in close proximity of the track in a cooperative manner, thereby causing part of the flat material under the first creasing surface to bend between the first and second creasing surfaces; and (E) a movement mechanism for moving the housing and the print head along a moving and printing direction substantially perpendicular to the moving path of the flat material when the track and the first creasing surface are positioned at the second position so as to move the first creasing surface from a first side of the flat material to an opposing second side of the flat material one or more times for causing said bending on the flat material to form one or more creases in the flat material at the proper locations of the flat material to facilitates folding or the flat material.

2. The creasing device of claim 1, wherein the printing is carried out by moving the print-head in a printing direction substantially perpendicular to the moving path of the flat material.

3. The creasing device of claim 1, wherein the print head is fixedly mounted on the housing.

4. The creasing device of claim 1, wherein the print head is mounted separately from the housing.

5. The creasing device of claim 1, wherein the first creasing surface has a first angular shape and the second creasing surface has a second angular shape substantially complementary to the first angular shape.

6. The creasing device of claim 1, wherein the housing comprises at least one roller disposed on a rotation axis for rotation, the rotation axis substantially parallel to the path direction of the flat material, the roller having a roller periphery, and wherein the first creasing surface is disposed on the roller periphery of said at least one roller.

7. The creasing device of claim 6, wherein the shifting mechanism is operatively connected to the track for causing the track to operate between a retracted position and a raised position relative to the printer surface, and wherein:

(i) when the track and the roller are positioned in the first position, the track is operated in the retracted position, and (ii) when the track and the roller are positioned in the second position, the track is operated in the raised position.

8. The creasing device of claim 6, wherein the shifting mechanism is operatively connected to the roller for causing the roller to operate between a raised position and a lowered position relative to the printer surface, and wherein:

(i) when the track and the roller are positioned in the first position, the roller is operated in the raised position, and (ii) when the track and the roller are positioned in the second position, the roller is operated in the lowered position.

9. The creasing device of claim 6, wherein the first creasing surface comprises a concave surface and first angular shape is a V-shape, and the second creasing surface comprises a convex surface.

10. The creasing device of claim 6, wherein the second creasing surface comprises a concave surface and second angular shape is a V-shape, and the first creasing surface comprises a convex surface.

11. The creasing device of claim 1, wherein the first creasing surface comprises a first surface substantially perpendicular to the printer surface and parallel to the moving direction of the housing, and the second creasing surface comprises a second surface substantially parallel to the first surface such that the first and second surfaces form a gap there between when the track, and the first creasing surface is positioned in the second position.

* * * * *